US005558542A

United States Patent [19]

O'Sullivan et al.

[11] Patent Number: 5,558,542

[45] Date of Patent: Sep. 24, 1996

[54] ELECTRICAL CONNECTOR WITH IMPROVED TERMINAL-RECEIVING PASSAGE MEANS

[75] Inventors: Michael O'Sullivan, Willowbrook; James A. Wetter, Hoffman Estates, both of Ill.

[73] Assignee: Molex Incorporated, Lisle, Ill.

[21] Appl. No.: 525,324

[22] Filed: Sep. 8, 1995

[51] Int. Cl.[6] ..... H01R 13/10

[52] U.S. Cl. ..... 439/682; 439/857

[58] Field of Search ..... 439/101, 108, 439/607, 608, 660, 682, 857

[56] References Cited

U.S. PATENT DOCUMENTS

| | | | |
|---|---|---|---|
| 4,846,711 | 9/1989 | Kobler et al. | 439/63 |
| 5,102,353 | 4/1992 | Brunker et al. | 439/608 |
| 5,104,341 | 4/1992 | Gilissen et al. | 439/608 |
| 5,304,069 | 4/1994 | Brunker et al. | 439/108 |

OTHER PUBLICATIONS

Molex Sales Drawing No. SDA 70928–9999 dated Apr. 27, 1994.

Enlargement of terminal cavity of Molex Sales Drawing SDA No. 70928–9999, undated.

*Primary Examiner*—Khiem Nguyen

*Attorney, Agent, or Firm*—Charles S. Cohen

[57] ABSTRACT

An electrical connector includes a dielectric housing mounting a plurality of terminals. Each terminal includes a blade portion terminating in a distal contact end formed by dual spaced-apart cantilevered spring arms with mutually opposing contact portions defining a conductor-receiving mouth therebetween. The spring arms are cantilevered at opposite edges of the blade portion and are offset on opposite sides of the blade portion. A plurality of passages are formed in the housing and into which the blade portions of the terminals project. Each passage includes opposing side walls generally parallel to the blade portion of the respective terminal in the passage. Each side wall includes a laterally outwardly offset portion to accommodate one of the offset spring arms at the distal contact end of the terminal.

3 Claims, 4 Drawing Sheets

ELECTRICAL CONNECTOR WITH IMPROVED TERMINAL-RECEIVING PASSAGE MEANS

FIELD OF THE INVENTION

This invention generally relates to the art of electrical connectors and, particularly, to an improved terminal-receiving passage arrangement which allows for the connector housing to be dimensionally reduced while still providing adequate structural integrity.

BACKGROUND OF THE INVENTION

A known type of input/output (I/O) electrical connector includes a dielectric housing having a front mating face and a rear face with a terminal-receiving cavity therebetween. A plurality of terminals are mounted in the cavity, with portions of the terminals, such as female portions, extending into passages of the dielectric housing for mating with male terminals of a complementary mating connector. Most often, the terminals have enlarged body sections which are used to fix the terminals within the connector housing.

In other connectors of this type, a plurality of terminal modules are insertable into the housing cavity, with each module including a dielectric insert or strip surrounding a plurality of the terminals. The dielectric insert may be overmolded about the body sections of the plurality of terminals. For instance, thin elongated terminal modules may be positioned in a side-by-side or "stacked" array within the housing cavity.

In connectors of this type, the female contact portions of the terminals project into passages in a mating portion of the dielectric housing whereby the female contact portions are protected within the passages. The male terminals of the complementary mating connector are inserted into the passages for interconnection with the female contact portions. The dielectric housing most often is an elongated structure having longitudinal rows of passages extending lengthwise of the housing for receiving longitudinal rows of terminals or the thin elongated terminal modules. These rows of passages define transverse columns of passages spaced lengthwise of the housing. Because the female contact portions of the terminals normally comprised enlarged portions of the terminals, the passages must be enlarged to accommodate the female contact portions, and the size of the passages often dictate the dimensions of the overall connector. Since size is a critical factor in many circuitry layouts, accommodating the enlarged female contact portions of the terminals often cause problems in dimensional designing. Simply placing the passages in the housing closer together or at a smaller "pitch" often is not a solution, because the walls of the housing between the passages become too thin, resulting in insufficient supporting structure as well as making it difficult to mold the housing.

The present invention is directed to solving the myriad of problems discussed above by providing an improved terminal-receiving passage structure and, particularly, a passage arrangement for accommodating the female contact portions of specific terminals. Still further, the invention is directed to an improved passage structure for accommodating terminals with female contact portions defined by dual spaced-apart cantilevered spring arms which are offset on opposite sides of blade portions of the terminals.

SUMMARY OF THE INVENTION

An object, therefore, of the invention is to provide an electrical connector with a new and improved terminal-receiving passage structure or arrangement.

In the exemplary embodiment of the invention, the connector includes a dielectric housing having means for mounting a plurality of terminals. Each terminal includes a blade portion terminating in a distal contact end formed by dual spaced-apart cantilevered spring arms with mutually opposing contact portions defining a conductor-receiving mouth therebetween. The spring arms are cantilevered at opposite edges of the blade portion and offset on opposite sides of the blade portion. A plurality of passages are provided in the housing into which the blade portions project. Each passage includes opposing side walls generally parallel to the blade portion of the respective terminal in the passage. Each side wall includes a laterally outwardly offset portion to accommodate one of the offset spring arms at the distal contact end of the terminal.

More particularly, the passages are generally rectangular, and the laterally outwardly offset portions of the side walls of each passage are located adjacent one pair of diagonally opposite corners of the passage. The other pair of diagonally opposite corners of each passage are angled or indented inwardly toward the blade portion of the terminal. At least some of the passages are disposed in a row in the housing, with the opposing offset portions of the side walls of one passage in the row being adjacent the opposing side walls of adjacent passages in the row. Preferably, the laterally outwardly offset portion of each side wall extends lengthwise of the side wall less than 50% thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
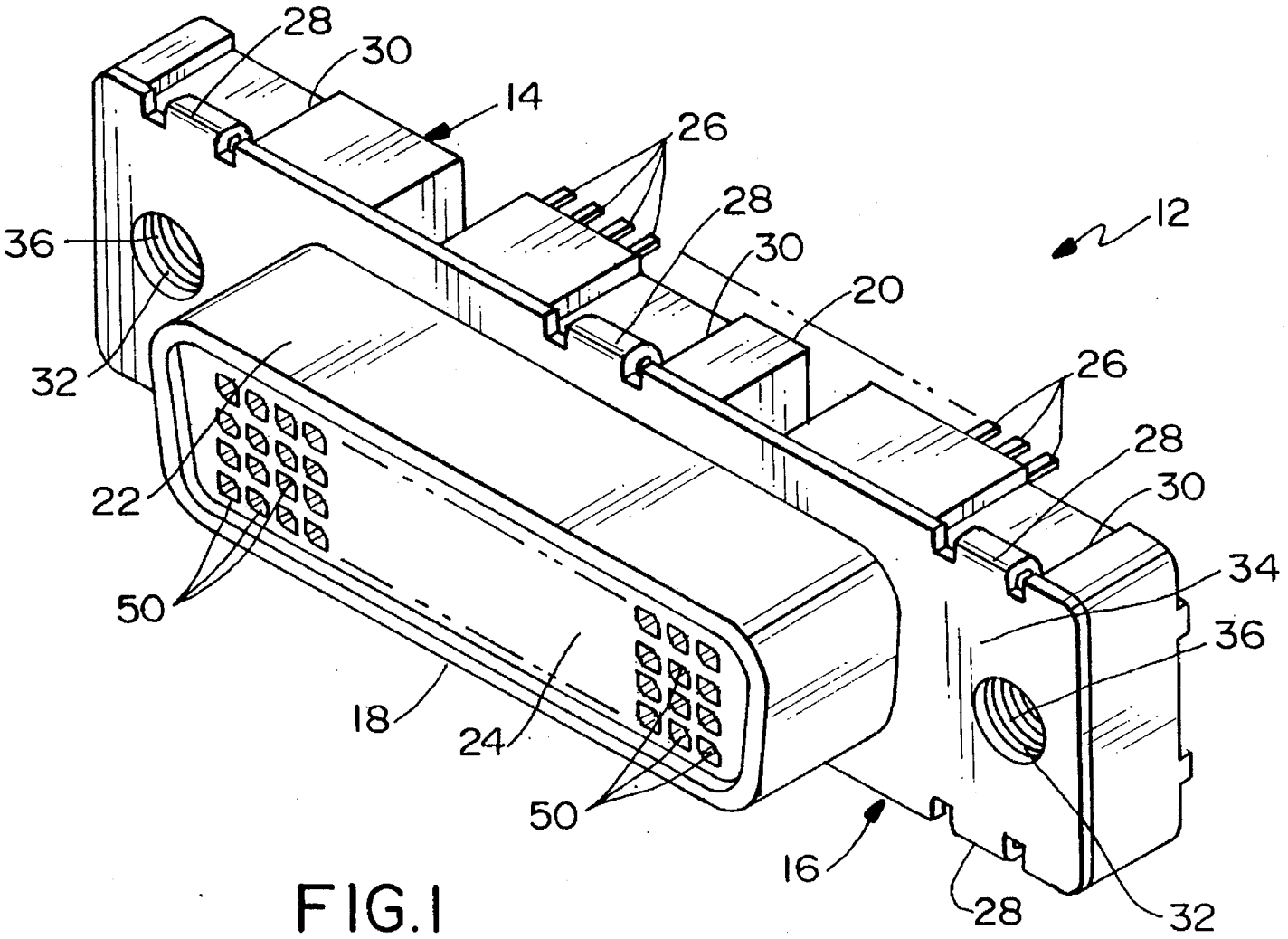
FIG. 1 is a perspective view of an electrical connector embodying the concepts of the invention.
Figure 3:
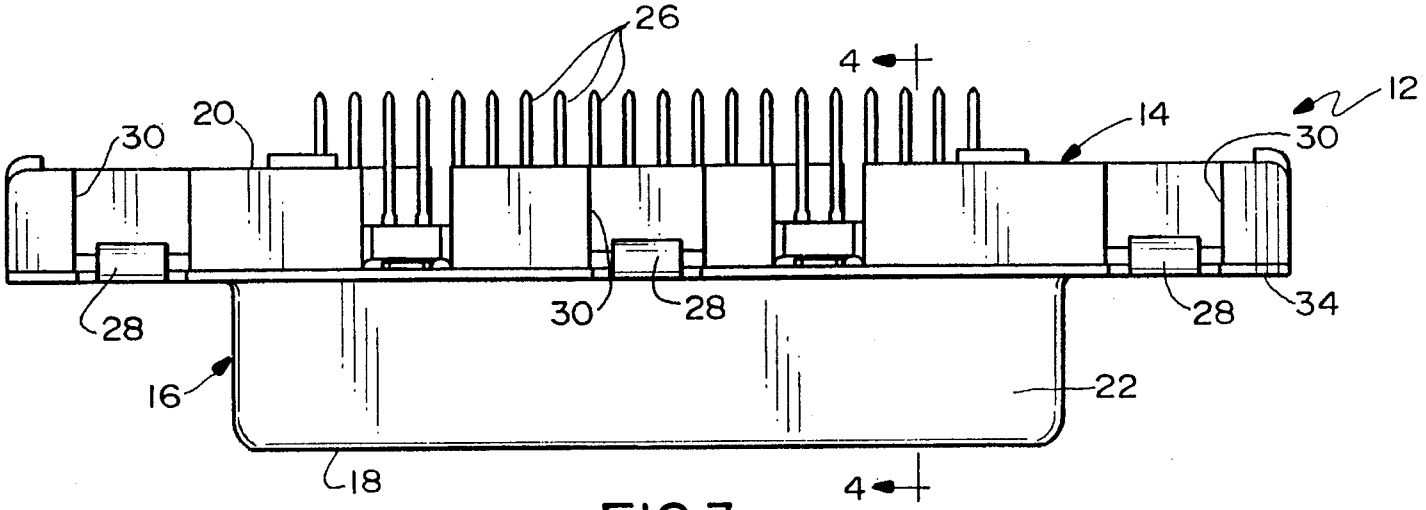
FIG. 3 is a top plan view of the connector.

Referring to the drawings in greater detail, and first to FIGS. 1–4, the invention is embodied in an electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of sheet metal material.

The connector is an input/output (I/O) electrical device wherein shield 16 defines a front mating face 18 of the connector, and housing 14 defines a rear terminating face 20. The front face actually is formed by a D-shaped shroud 22 of the shield surrounding a complementarily shaped, forwardly projecting mating portion 24 of the housing within the shroud portion. Tail portions 26 of a plurality of terminals (described hereinafter) project from rear face 20 of the connector for insertion into appropriate holes in a printed circuit board for connection to circuit traces on the board and/or in the holes. As seen in FIG. 1, rearwardly formed tabs 28 of shield 16 embrace housing 14 within recesses 30 therein. Lastly, holes 32 in a base plate 34 of shield 16 are aligned with internally threaded holes 36 in housing 14 for receiving appropriate threaded fasteners for fastening the connector to the circuit board and/or to a complementary mating connector.

Figure 4:
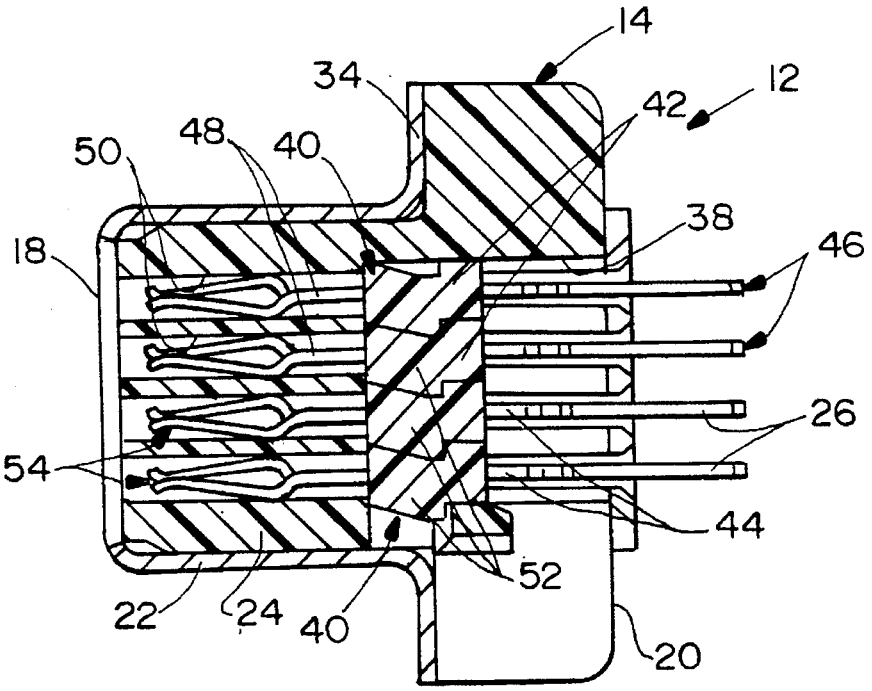
FIG. 4 is a vertical section, on an enlarged scale, taken generally along line 4—4 of FIG. 3.

FIG. 4 best shows that housing 14 of connector 12 includes a longitudinal cavity 38 for receiving a plurality of terminal modules, generally designated 40, in a side-by-side array of modules within the cavity. Each module includes a one-piece longitudinal dielectric insert 42 which is overmolded about body or base sections 44 of a plurality of female terminals, generally designated 46. Each terminal includes a forwardly projecting blade portion 48 along with the rearwardly projecting tail portion 26 extending from opposite ends of body section 44. Blade portions 48 extend into passages 50 in mating portion 24 of housing 14, and tail portions 26 project outwardly of housing cavity 38 beyond rear terminating face 20 of the connector.

Terminal modules 40 are interengaged in their side-by-side array within housing cavity 38. In particular, latch projections 52 project outwardly from the sides of dielectric inserts 42 of the modules into complementary recesses in the opposite sides of the inserts of adjacent modules.

Figure 2:
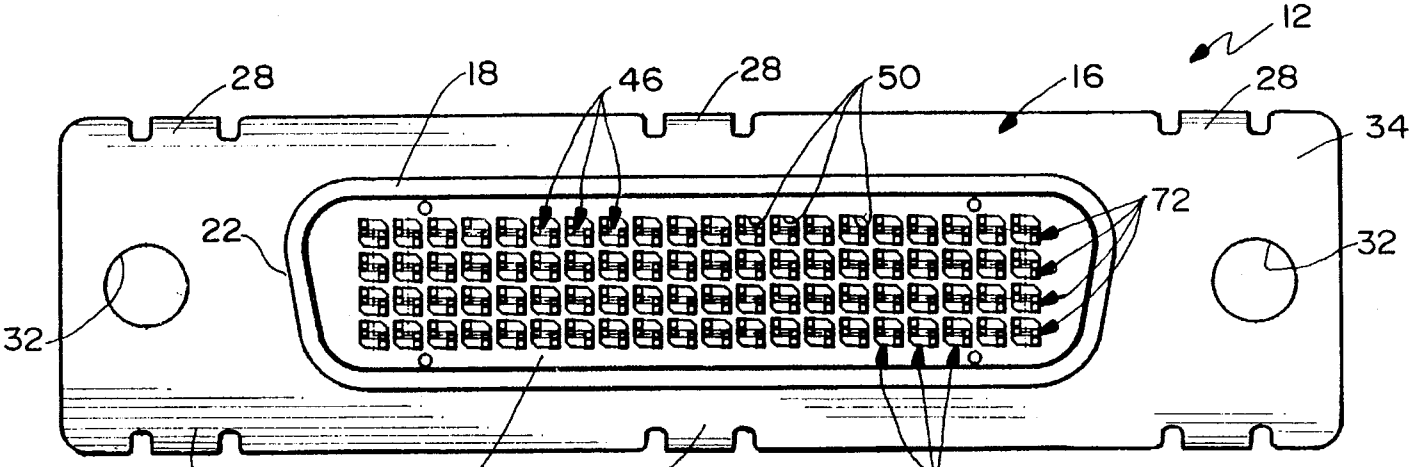
FIG. 2 is a front elevational view of the connector.
Figure 5:
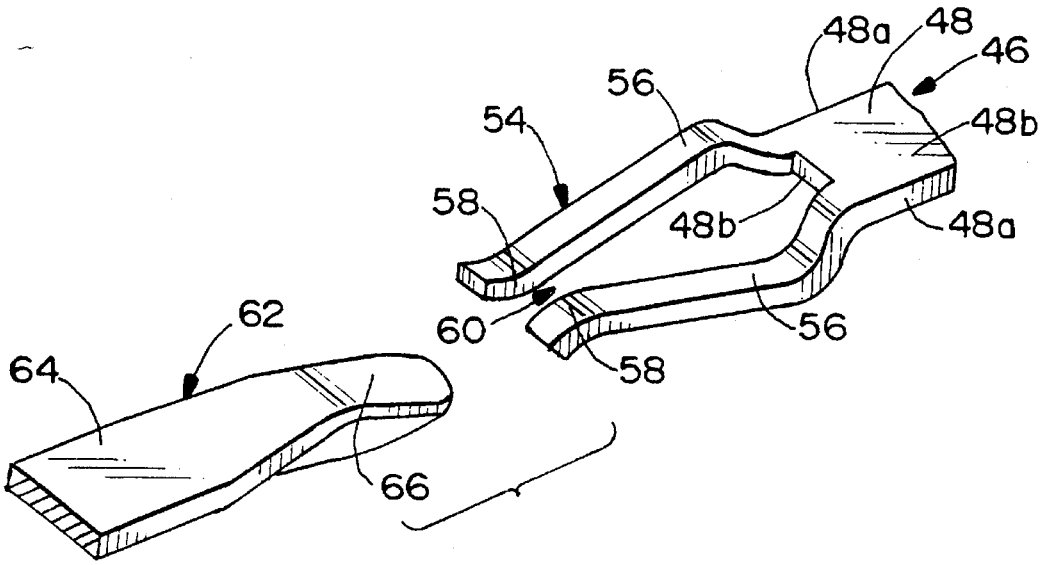
FIG. 5 is a perspective view of the distal contact end of one of the female terminals received in the connector, along with the distal end of a complementary male terminal.

Referring to FIG. 5 in conjunction with Figures 1–4, and particularly FIGS. 2 and 4, the forwardly projecting blade portion 48 of each female terminal 46 terminates in a distal contact end, generally designated 54, formed by dual spaced-apart cantilevered spring arms 56 having mutually opposing contact portions 58 defining a conductor-receiving mouth, generally designated 60, therebetween. Actually, the conductor-receiving mouth is adapted to be a terminal-receiving mouth for receiving a complementary mating terminal, generally designated 62 in FIG. 5. The mating male terminal has a blade portion 64 terminating in a twisted distal contact end 66. Blade portion 64 of male terminal 62 is generally coplanar with blade portion 48 of female terminal 46. It can be seen in FIG. 5 that spring arms 56 are cantilevered at opposite edges **48*a* of blade portion 48 and are offset on opposite sides 48*b* of the blade portion. When twisted distal contact end 66 of male terminal 62 is inserted into mouth 60 of female terminal 36, minimal insertion forces are encountered until the twisted distal end merges with blade portion 64 of the male terminal whereupon spring arms 56 of the female terminal are spread apart to biasingly engage opposite sides of blade portion 64** of the male terminal. A similar terminal arrangement is shown in U.S. Pat. No. 5,290,181, dated Mar. 1, 1994 and assigned to the assignee of the present invention, and which is incorporated herein by reference.

Figure 6:
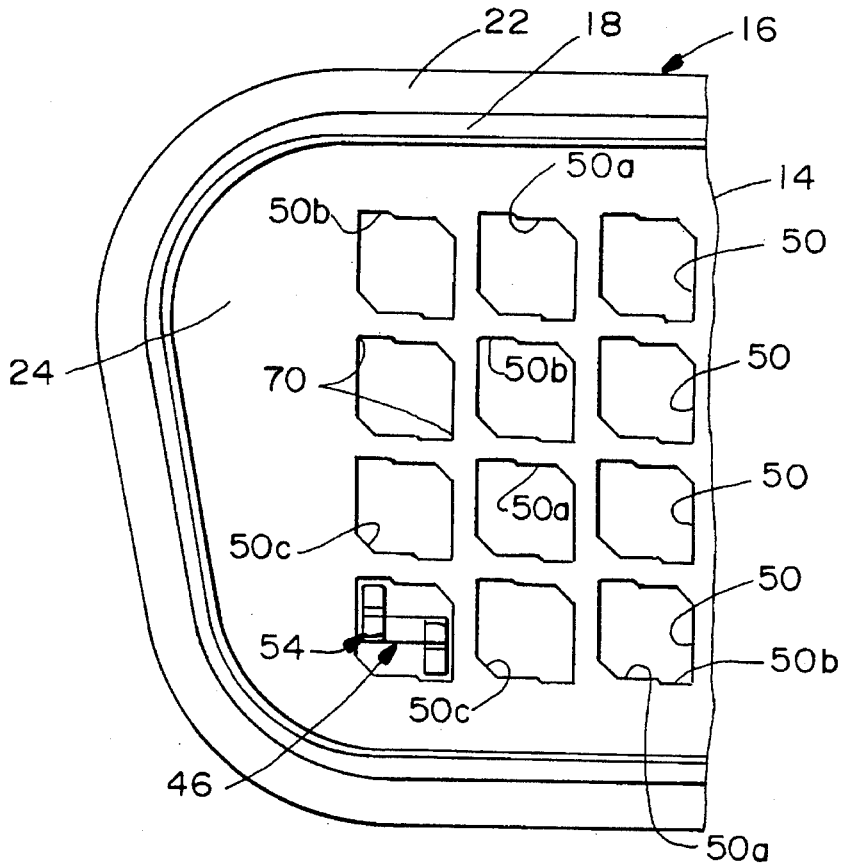
FIG. 6 is a fragmented elevational view showing an enlarged depiction of some of the terminal-receiving passages at one end/of the connector.
Figure 7:
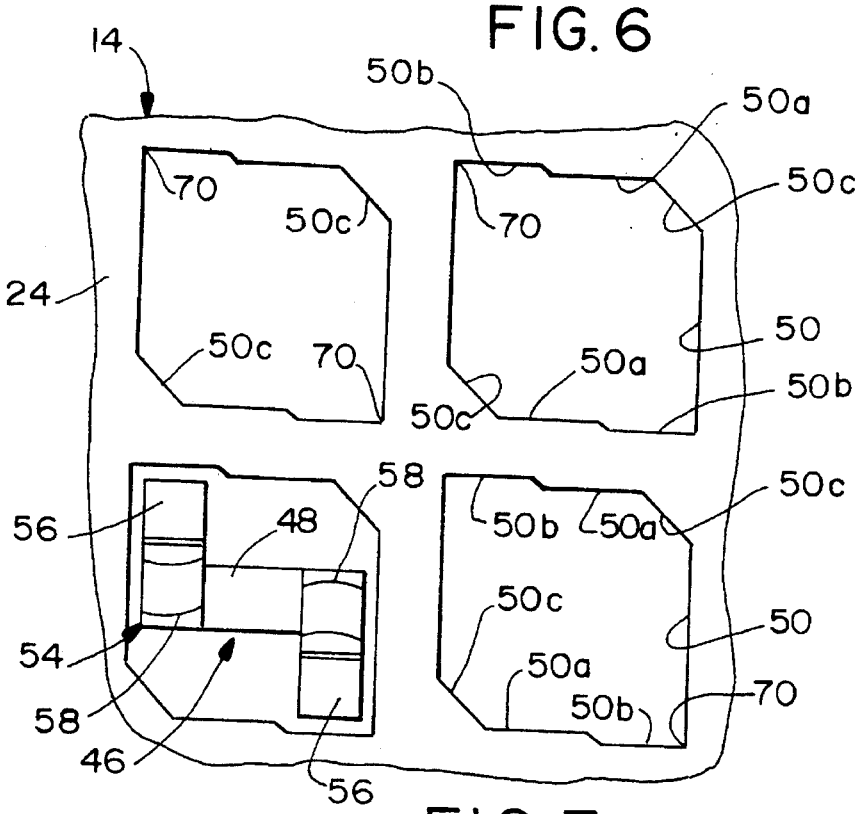
FIG. 7 is a fragmented elevational view showing a further enlargement of four of the passages as depicted in FIG. 6.

Referring to FIGS. 6 and 7, a plurality of passages 50 in mating portion 24 of housing 14 are shown in enlarged depictions, with only one terminal disposed in the bottom left-hand passage so as not to clutter a the depiction of the passage configurations. More particularly, each passage 50 is generally rectangular and includes a pair of opposing side walls **50*a* which are generally parallel to blade portion 48 of the respective female terminal 46 in the passage. In addition, each side wall 50*a* includes a laterally outwardly offset portion 50*b* to accommodate one of the offset spring arms 56 at the distal contact end 54 of the female terminal. It can be seen that offset portions 50*b* of side walls 50*a* are located adjacent one pair of diagonally opposite corners 70 of each passage. The other pair of diagonally opposite corners of each passage are angled inwardly, as at 50*c*, toward the blade portion of the terminal. Lastly, it can be seen in FIGS. 6 and 7 that offset portions 50*b* of passages 50 extend less than 50% of the lengths of side walls 50*a*** of the passages.

Still referring to FIGS. 6 and 7 in conjunction with FIG. 2, it can be seen that passages 50 are arranged in longitudinal rows 72 (FIG. 2) lengthwise of the elongated connector, and the passages are arranged in transverse rows or columns 74 generally perpendicular to the longitudinal rows. In essence, the configuration of passages 50 accommodates contact ends 54 of terminals 46 and allows the passages to be disposed closer together transversely of the connector, i.e., in within rows 74, while still maintaining adequate housing wall support between the passages. This allows for the connector to be dimensionally reduced in its transverse direction. This can be understood by the most enlarged depiction of passages 50 in FIG. 7, wherein its can be seen that the offset portions **50*b* of any one passage is adjacent or across from the non-offset side wall 50*a* of the adjacent passages in the rows. This increases the wall thickness between any two passages at any given point between two adjacent passages transversely of the connector. In other words, if opposing side walls 50*a* of each passage was located coincident with the offset portions 50*b*, the thickness of the walls between the passages would be reduced. Lastly, by indenting the corners of the passages, as at 50*c***, still further plastic material is allowed at the corners of adjacent passages in the longitudinal and transverse rows to provide further support of the housing at those locations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having means for mounting a plurality of terminals;

a plurality of terminals mounted in the housing, each terminal including a blade portion terminating in a distal contact end formed by dual spaced-apart cantilevered spring arms with mutually opposing contact portions defining a conductor-receiving mouth therebetween, the spring arms being cantilevered at opposite edges of the blade portion and offset on opposite sides of the blade portion; and a plurality of generally rectangular passages in the housing into which the blade portions project, each passage including opposing side walls generally parallel to the blade portion of the respective terminal in the passage, and each side wall including a laterally outwardly offset portion to accommodate one of the offset spring arms at the distal contact end of the terminal, said laterally outwardly offset portions of the side walls of each passage being located adjacent one pair of diagonally opposite corners of the passage, and the other pair of diagonally opposite corners of each passage are angled inwardly toward the blade portion of the terminal.

2. An electrical connector, comprising:

a dielectric housing having means for mounting a plurality of terminals;

a plurality of terminals mounted in the housing, each terminal including a blade portion terminating in a distal contact end formed by dual spaced-apart cantilevered spring arms with mutually opposing contact portions defining a conductor-receiving mouth therebetween, the spring arms being cantilevered at opposite edges of the blade portion and offset on opposite sides of the blade portion; and a plurality of rows of generally rectangular passages in the housing into which the blade portions of the terminals project, each passage including opposing side walls generally parallel to the blade portion of the respective terminal in the passage, and each side wall including a laterally outwardly offset portion to accommodate one of the offset spring arms at the distal contact end of the terminal, the offset portions of the side walls of each passage being located adjacent one pair of diagonally opposite corners of the passage, the offset portions of the side walls of each passage extending less than 50% of the respective side wall, the offset portions of the side walls of the passages in a row being adjacent the opposing side walls of adjacent passages in the row, and the other pair of diagonally opposite corners of each passage are indented inwardly toward the blade portion of the terminal.

3. An electrical connector, comprising:

a dielectric housing having means for mounting a plurality of terminals;

a plurality of terminals mounted in the housing, each terminal including a blade portion terminating in a distal contact end formed by dual spaced-apart cantilevered spring arms with mutually opposing contact portions defining a conductor-receiving mouth therebetween, the spring arms being cantilevered at opposite edges of the blade portion and offset on opposite sides of the blade portion; and a plurality of passages in the housing into which the blade portions project, each passage being generally rectangular and including a pair of diagonally opposite corners remote from the offset spring arms of the respective terminal in the passage, the corners being indented inwardly toward the blade portion of the terminal.

* * * * *